US007105807B2

(12) United States Patent
Hansen

(10) Patent No.: US 7,105,807 B2
(45) Date of Patent: Sep. 12, 2006

(54) MULTI DYNODE DEVICE AND HYBRID DETECTOR APPARATUS FOR MASS SPECTROMETRY

(75) Inventor: Stuart C. Hansen, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 479 days.

(21) Appl. No.: 10/617,597

(22) Filed: Jul. 11, 2003

(65) Prior Publication Data

US 2004/0108451 A1 Jun. 10, 2004

Related U.S. Application Data

(62) Division of application No. 09/541,209, filed on Apr. 3, 2000, now Pat. No. 6,617,768.

(51) Int. Cl.
*H01J 49/26* (2006.01)

(52) U.S. Cl. ..... 250/283; 250/287

(58) Field of Classification Search ..... 250/283, 250/287; 313/103, 105 CM, 533
See application file for complete search history.

(56) References Cited

U.S. PATENT DOCUMENTS 5,464,975 A * 11/1995 Kirchner et al. ..... 250/283
6,617,768 B1 * 9/2003 Hansen ..... 313/103 CM

* cited by examiner

*Primary Examiner*—Kiet T. Nguyen

(57) ABSTRACT

A multi dynode device (MDD) for electron multiplication and detection and a hybrid detector using the MDD have high peak signal output currents and large dynamic range while preserving the time-dependent information of the input event and avoiding the generation of significant distortions or artifacts on the output signal. The MDD and hybrid detector overcome saturation problems observed in conventional hybrid detectors by providing a unique electron multiplier portion that avoids the path-length differences. The MDD and hybrid detector can be used in mass spectrometry, in particular, time-of-flight mass spectrometry. The MDD comprises a plurality of dynode plates arranged in a stacked configuration. Each dynode plate in the stack has a plurality of apertures for cascading secondary electrons through the stack. Each aperture comprises a mechanical bias or offset with respect to the apertures in adjacent plates. The offset is such that the electrons will impact with one or more of the dynode plates. The MDD further comprises a power source to provide a voltage bias to the dynode plates. The power source comprises a voltage supply and a voltage divider. Each dynode plate is connected to a tap on the voltage divider such that a voltage gradient is produced along the stack. The MDD can supply high peak currents. The hybrid detector comprises an input portion having a microchannel plate MCP and an output portion having the multi dynode device (MDD). The MCP and MDD are adjacent to one another. The MDD is planar, flat, and compact like that of the MCP, such that important temporal integrity of an input signal event is preserved.

3 Claims, 6 Drawing Sheets

MULTI DYNODE DEVICE AND HYBRID DETECTOR APPARATUS FOR MASS SPECTROMETRY

This is a divisional of application Ser. No. 09/541,209, filed on Apr. 3, 2000 now U.S. Pat. No. 6,617,768, the entire disclosure of which is incorporated herein by reference.

TECHNICAL FIELD

This invention relates to ion detectors for mass spectrometry. In particular, the invention relates to a hybrid electron multiplier detector for time of flight mass spectrometry.

BACKGROUND ART

Mass spectrometry is an analytical methodology often used for quantitative elemental analysis of materials and mixtures of materials. In mass spectrometry, a sample of a material to be analyzed called an analyte is broken into particles of its constituent parts. The particles are typically molecular in size. Once produced, the analyte particles (ions) are separated by the spectrometer based on their respective masses. The separated particles are then detected and a "mass spectrum" of the material is produced. The mass spectrum is analogous to a fingerprint of the sample material being analyzed. The mass spectrum provides information about the masses and in some cases quantities of the various analyte particles that make up the sample. In particular, mass spectrometry can be used to determine the molecular weights of molecules and molecular fragments within an analyte. Additionally, mass spectrometry can identify components within the analyte based on the fragmentation pattern when the material is broken into particles (fragments). Mass spectrometry has proven to be a very powerful analytical tool in material science, chemistry and biology along with a number of other related fields.

A specific type of mass spectrometer is the time-of-flight (TOF) mass spectrometer. The TOF mass spectrometer (TOFMS) uses the differences in the time of flight or transit time through the spectrometer to separate and identify the analyte constituent parts. In the basic TOF mass spectrometer, particles of the analyte are produced and ionized by an ion source. The analyte ions are then introduced into an ion accelerator that subjects the ions to an electric field. The electric field accelerates the analyte ions and launches them into a drift tube or drift region. After being accelerated, the analyte ions are allowed to drift in the absence of the accelerating electric field until they strike an ion detector at the end of the drift region. The drift velocity of a given analyte ion is a function of both the mass and the charge of the ion. Therefore, if the analyte ions are produced having the same charge, ions of different masses will have different drift velocities upon exiting the accelerator and, in turn, will arrive at the detector at different points in time. The differential transit time or differential 'time-of-flight' separates the analyte ions by mass and enables the detection of the individual analyte particle types present in the sample.

When an analyte ion strikes the detector, the detector generates a signal. The time at which the signal is generated by the detector can be used to determine the mass of the particle striking it. In addition, for many detector types, the strength of the signal produced by the detector is proportional to the quantity of the ions striking it at a given point in time. Therefore, for these detector types, the quantity of particles of a given mass often can be determined as well as the time of arrival. With this information pertaining to particle mass and quantity, a mass spectrum can be computed and the composition of the analyte can be inferred.

Of significant importance to the performance of a TOF mass spectrometer is the design and performance of the ion detector. Ideally, the detector should have high sensitivity, low noise and high dynamic range. In addition, the detector should provide good temporal resolution. Sensitivity is a measure of the ability of the detector to register the presence of particles arriving individually. An ideal detector would be able to register the arrival of a single ion of any mass and arbitrary energy. However, in practice, detectors often require a number of ions arriving simultaneously to produce a measurable response or signal. High sensitivity refers to the ability of a detector to produce a measurable signal from the impact of a single or very small number of ions. Dynamic range, on the other hand, is a measure of the ability of the detector to produce a signal that is proportional to the number of particles striking the detector at a given point in time. High dynamic range refers to the situation when there are a very large number of particles striking the detector and the detector is still able to produce a signal that is proportional to the number of particles. Temporal resolution refers to the ability of a detector to distinguish between particles based on time of arrival. The arrival of a particle at a detector is often referred to as an "event". If two events occur at times that are less than the time resolution of the detector, the particles will be indistinguishable and will be registered by the detector as having the same mass. Therefore, time resolution afforded by a detector determines the mass resolution of the TOF mass spectrometer.

A number of different detector types are used in TOF mass spectrometers. Among these are the channeltron, Daly detector, electron multiplier, Faraday cup, and microchannel plate (MCP). The channeltron is a horn-shaped continuous dynode. The inside of the channeltron is coated with an electron emissive material such that when an ion strikes the channeltron it creates secondary electrons. These secondary electrons create more electrons in an avalanche effect and are ultimately detected as a current pulse at the output of the channeltron. The Daly detector is made up of a metal knob that produces secondary electron emissions when struck by an ion. The secondary electrons are accelerated in the Daly detector and, in turn, strike a scintillator that produces photons. The photons are detected as light by a photomultiplier tube (PMT) that then produces the output signal of the detector indicating the presence of an ion impact. An electron multiplier (EM) is similar to a photomultiplier and consists of a series of biased dynodes that emit secondary electrons when the first dynode is struck by an ion. A Faraday cup is a metal cup placed in the path of the ion beam. The cup is connected to an electrometer that measures the ion-current of the beam. The microchannel plate (MCP) is an array of glass capillaries the inside surfaces of which are coated with an electron-emissive material. The capillaries, which typically have an inner diameter of 10–25 um, are biased at high voltage so that when an ion strikes the electron-emissive coating, an avalanche of secondary electrons is produced. The secondary electron avalanche cascade effect creates a gain of between $10^3$ and $10^4$ and ultimately produces an output current pulse corresponding to the initial ion impact event.

FIG. 1 illustrates a typical MCP 10 detector configuration along with an expanded close-up cross-section 18 of a single channel within the MCP. The MCP 10 is positioned in front of an anode plate 11 such that the analyte ions 12 strike the MCP 10 instead of the anode plate 11. An analyte ion 12 that enters a channel 14 eventually strikes the sidewall 15 of the channel 14 within the MCP 10. The sidewall 15 is coated with an electron emissive material. The impact of the analyte ion 12 on the electron-emissive material coating the sidewall 15 causes the emission of secondary electrons 16. The secondary electrons 16 created by the impact of the analyte ion 12 radiate from their point of creation and often impact the sidewalls 15 of the channel 14, for example, as illustrated in FIG. 1. Each impact of secondary electrons 16 with a sidewall 15 can result in the creation of more secondary electrons 16. The end result is that one analyte ion 12 results in the creation of a large number of secondary electrons 16 that ultimately exit the MCP 10 and strike the anode plate 11, often a Faraday cup, where they can be detected as a current pulse. The total number of secondary electrons exiting the MCP and striking the anode plate 11 that are produced by the impact of a single analyte ion 12 is often called the detection gain of the MCP 10. The MCP 10 in this configuration functions as an electron multiplier (EM).

The number of secondary electrons 16 produced by the MCP 10 is proportional to the length of the channels 14 in the MCP 10. A longer channel 14, in principle, will result in more impacts and thus, the production of more secondary electrons 16. However, there is a practical limit to the detection gain of a given MCP 10. Once a sufficient number of secondary electrons 16 has been produced, further production of secondary electrons 16 is inhibited by the current or electric field associated with the secondary electrons already produced. This phenomenon results in saturation of the detector. Saturation limits the achievable gain in the MCP 10 detector. In addition, electrons under high concentration conditions can cause positive ions to be formed which travel backward in the channel. The backward motion known as "feedback" hurries the onset of saturation and can cause the creation of ghost peaks or artifacts in the detected output. Similar saturation limits and ghost peaks are observed in the other detector types as well when these detectors are designed simultaneously for high gain, high sensitivity and high dynamic range.

Recently, hybrid electron multiplier detectors have been developed to improve the gain and reduced or overcome the saturation limits, and to increase the dynamic range of the above-described detectors without introducing artifacts. Typically, these hybrid detectors have been created by cascading two of the above referenced multiplier types. The objective of these hybrid combinations is to overcome the above-described inherent limitations of non-hybrid detectors in terms of the detection sensitivity, gain, dynamic range and resolution of very fast and/or short-lived input events that represent the data of interest in TOF measurements, as in TOF mass spectrometry (TOFMS).

One example of such a hybrid detector, known as a Chevron configuration, is illustrated in FIG. 2*a*. In the Chevron configuration hybrid detector 20, a second MCP 21 is placed between the first MCP 10 and the anode plate 11. The first MCP 10 in the Chevron configuration hybrid detector 20 of FIG. 2*a*, like the MCP 10 of FIG. 1, provides a large, flat detection surface to the incoming ions or ion packets. These ions are detected synchronously in time, thereby providing this hybrid detector 20 with high sensitivity. However, in the Chevron configuration, the second MCP 21 provides additional gain beyond that produced by the first MCP 10 since the second MCP 21 intercepts the secondary electrons produced by the first MCP 10 and produces even more secondary electrons. Furthermore, unlike the case of lengthening the channels to increase gain, the use of a second MCP 21 allows for greater dynamic range through a delay in the onset of saturation. The delay in the onset of saturation is produced by careful, independent design of the individual MCPs 10, 21 and through independently setting the bias levels of the pair of MCPs 10, 21. In principle, the first MCP 10 is designed and biased for high sensitivity and the second MCP 21 is designed and biased for high saturation. Thus, by cascading two MCPs 10, 21 in the Chevron configuration, the gain of the overall detector 20 is improved and the saturation level is increased compared that of a single MCP 10 design. The Chevron configuration of MCPs 10,21 has been shown to achieve detection gains of $10^6$ to $10^8$.

Unfortunately, even though the two MCPs 10, 21 of the Chevron configuration can be designed and biased independently, this type of hybrid detector 20 still suffers from relatively severe limitation in gain due to saturation, which limits the useful gain of this type of hybrid detector. Further, the Chevron configuration has low dynamic range due to the inherently high resistance of the MCP plates. The high resistance limits the secondary electron production once large numbers of electrons are present, which is particularly evident in and problematic for the second MCP 21. Additionally, ghost peaks or artifacts due to ion feedback can still be produced.

A second approach to hybrid detector design is a hybrid detector 25 comprised of a combination of an MCP and a discrete dynode electron multiplier (DEM) 24 as illustrated in FIG. 2*b*. In this detector configuration 25, the secondary electrons output by the MCP 10 act as an input to the DEM 24. The DEM 24, in turn, provides further amplification of the detection signal by producing more secondary electrons from those output by the MCP 10. Unlike the MCPs 10, 21, the DEM 24 is capable of supporting large peak signal currents while maintaining linearity. That is, the DEM 24 is much less susceptible to saturation than the second MCP 21 of the Chevron configuration 20 of FIG. 2*a*. Thus, the first MCP 10 in this hybrid detector provides the desired high sensitivity while the DEM 24 produces additional gain and supports high currents necessary for high dynamic range.

Unfortunately, the DEM 24 has an inherent path-length difference for various ions and electrons. This path-length difference results in a widening of the output signal pulse, Δt, and the generation of spurious trailing pulses or peaks referred to as ghosts peaks or artifacts. The widening of the output signal pulse Δt and presence of spurious trailing pulses reduce the temporal resolution of the detector 25 and limits the useful dynamic range and resolution this type of hybrid detector 25.

The term "Δt" as used herein refers to the widening in time of the output secondary electron signal pulse after the impact of the analyte ion or input electron. For optimum performance, the detector should have a minimum Δt. In particular, for TOFMS, the minimization of the Δt of secondary electrons created from incoming primary analyte ions is very desirable. The Δt is ultimately related to the temporal resolution of the detector.

Conventional electron multipliers (EMs) used for hybrid detectors, such as the classic DEM, are not optimized for this low Δt requirement. For example, one of the best discrete DEMs has a dynode resembling a "venetian blind". In this particular EM, the ion-to-electron conversion or electron to secondary electron amplification takes place in an "in-line" manner as the electron avalanche proceeds down the length of the DEM structure. While this venetian-blind style dynode provides high sensitivity and dynamic range, the DEM exhibits a rather large Δt. The Δt in the "Venetian Blind" DEM is typically longer than 10 to 20 nanoseconds, which effectively sets the minimum temporal resolution or peak width of this detector type. Modern TOF mass spectrometry generally requires much better resolution than 10 to 20 nanoseconds.

Thus, it would be advantageous to have a hybrid detector with an EM that did not generate spurious trailing pulses or ghost peaks and artifacts, was not susceptible to high level saturation, and did not have inherent path length differences that result in loss of time resolution due to unacceptably high $\Delta t$. Such a hybrid detector would provide significant improvement to TOF mass spectrometry and solve a long-standing problem in the art.

SUMMARY OF THE INVENTION

The present invention provides an ion detector for use in mass spectrometry. The ion detector is a multi dynode device for electron multiplication and charged particle detection. In another embodiment, the ion detector is a hybrid detector comprising the multi dynode device (MDD) and an MCP. The hybrid electron multiplier detector has high peak signal output currents and large dynamic range while preserving the time-dependent information of the input event and avoiding the generation of significant distortions or artifacts on the output signal. The MDD of the present invention overcomes the above problems of the conventional hybrid detector by providing a unique EM portion, which avoids the path-length differences and maintains high peak current capability.

In one aspect of the invention, a multi dynode device (MDD) is provided comprising a plurality of dynode plates arranged in a stacked relationship with plurality of apertures formed in each of the plates. The apertures in a given plate are laterally offset relative to apertures in adjacent plates. Each dynode plate is adapted to be biased individually with a power source.

Electrons or ions entering the MDD at an input end or at a top end of the stack eventually strike one of the plates in the stack. The impact produces secondary electrons. The secondary electrons produced thereby are induced to move toward a bottom or an output end of the MDD under the influence of an electric field produced by bias voltages applied thereto via the power source. These secondary electrons either exit the MDD at its output end or impact another plate within the MDD producing additional secondary electrons. The power source of the MDD of the present invention comprises a voltage supply and a bias network. In the preferred embodiment, the bias network is a voltage divider. More preferably, the voltage divider is a capacitively loaded resistive voltage divider. Each dynode plate of the plurality is connected to a tap on the voltage divider. Thus, the MDD can supply high peak currents by virtue of the use of conductive plates and capacitively loaded bias circuitry.

In another aspect of the present invention, a hybrid electron multiplier detector is provided. The hybrid detector comprises an input portion and an output portion, wherein the output portion comprises a multi dynode device (MDD) and in the preferred embodiment, the input portion comprises a microchannel plate (MCP) adjacent to the MDD. The hybrid detector further comprises an anode for registering the electron pulse produced by the multiplier input portion and MDD.

The overall gain of the tandem arrangement of the MCP and MDD of the hybrid multiplier detector of the present invention is the product of the gains of the MCP and MDD. Moreover, the stacked configuration of the MDD provides a planar, flat, compact structure like that of the MCP, and so, preserves the important temporal integrity of an input signal event.

In still another aspect of the invention, a mass spectrometer is provided that comprises the elements of a conventional mass spectrometer, except that the ion detector is either the MDD or the hybrid electron multiplier detector described above. Preferably, the mass spectrometer is a time-of-flight mass spectrometer.

BRIEF DESCRIPTION OF THE DRAWINGS

The various features and advantages of the present invention may be more readily understood with reference to the following detailed description taken in conjunction with the accompanying drawings, where like reference numerals designate like structural elements, and in which.

MODES FOR CARRYING OUT THE INVENTION

Figure 1:
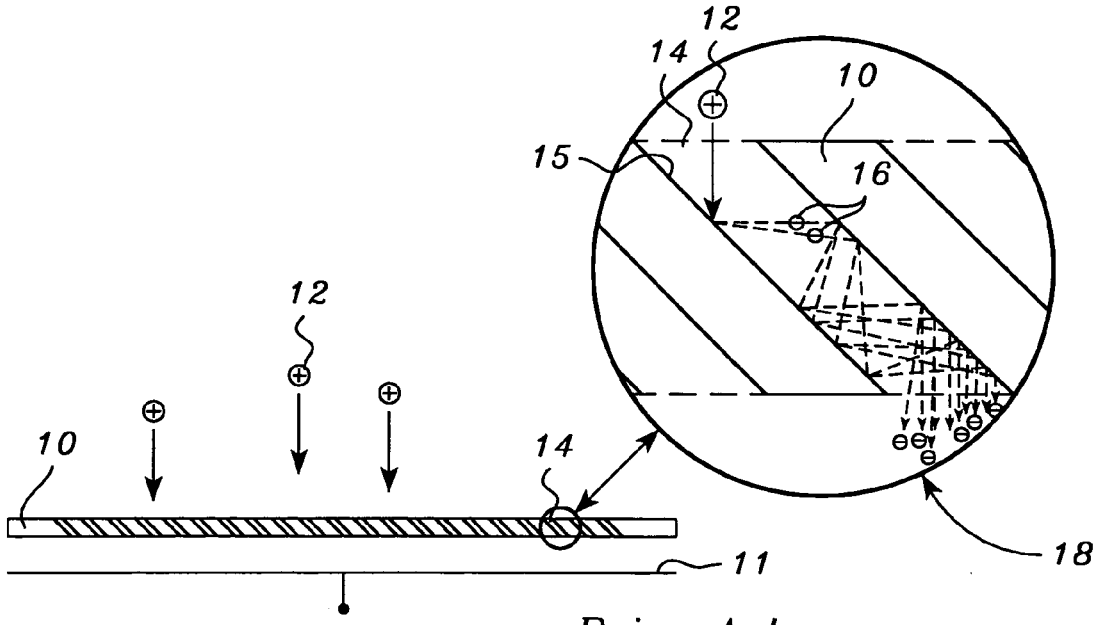
Prior Art FIG. 1
FIG. 1 illustrates a conventional microchannel plate ion detector of the prior art.
Figure 2A:
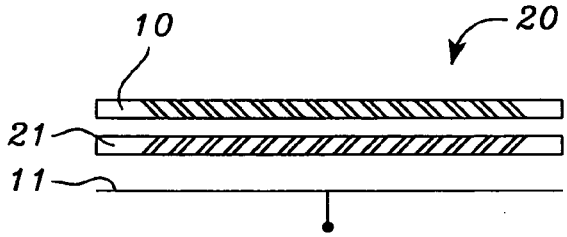
Prior Art FIG. 2a
FIG. 2*a* illustrates a conventional Chevron configuration, dual microchannel plate hybrid detector of the prior art.
Figure 2B:
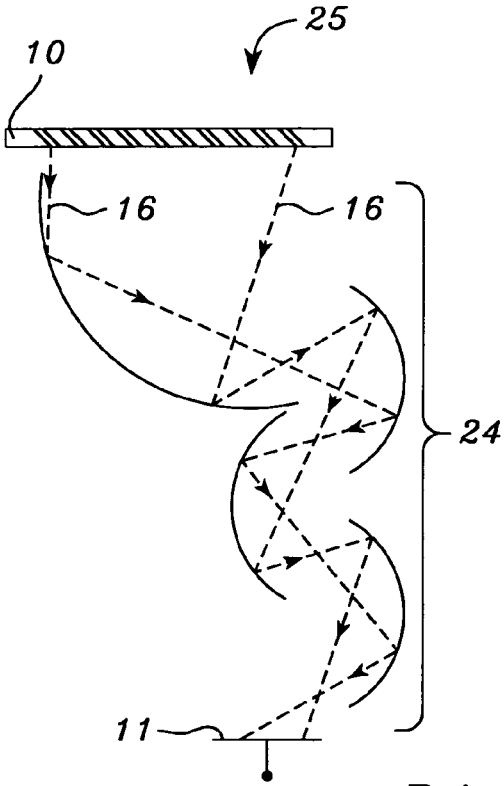
Prior Art FIG. 2b
FIG. 2*b* illustrates a conventional hybrid detector incorporating a microchannel plate followed by a dynode electron multiplier of the prior art.
Figure 3:
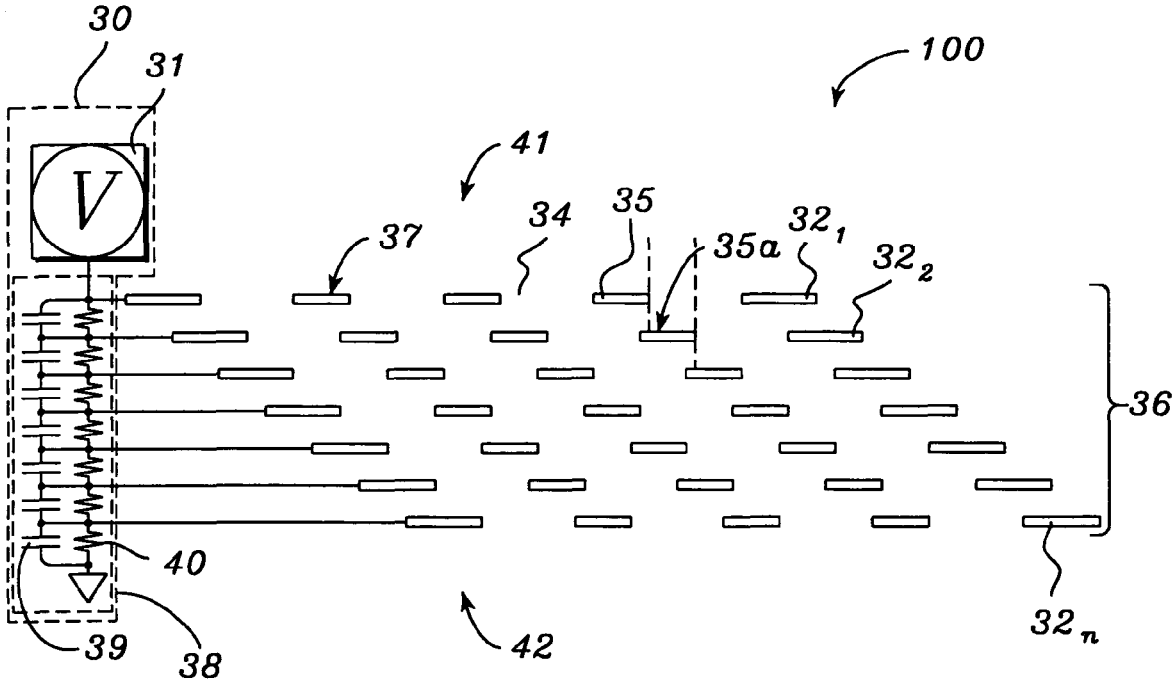
FIG. 3 illustrates a schematic diagram of a multi dynode device of the present invention.
Figure 4:
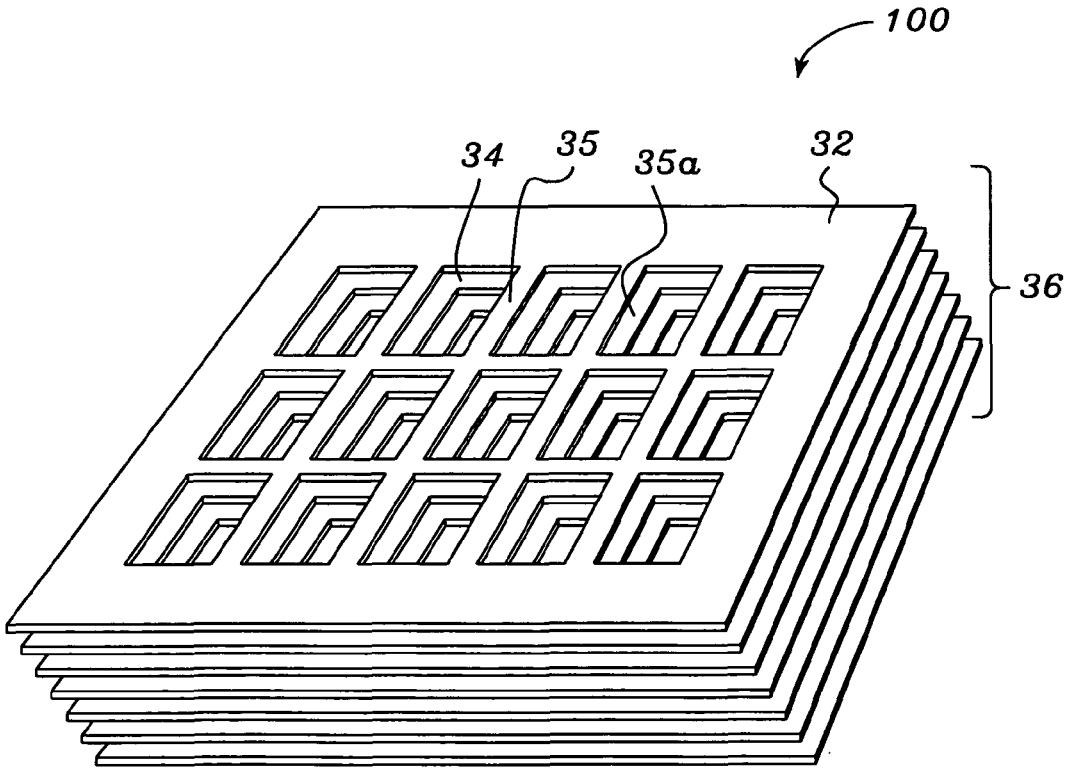
FIG. 4 is a perspective view of the dynode plates that make up the multi dynode device in accordance with the invention.

The multi dynode device (MDD) 100 of the present invention is illustrated in FIG. 3 in schematic form and in a perspective view in FIG. 4. The MDD 100 comprises a plurality of n conductive plates called dynode plates 32 arranged in a stack 36. Each dynode plate $\mathbf{32}_i$, where $i=1\rightarrow n$, has a plurality of apertures 34 formed therein. The dynode plates 32 in the stack 36 are spaced apart and laterally offset from one another. The MDD 100 further comprises a power source 30 comprising a bias network 38 and a bias voltage source 31. Bias voltages produced and supplied by the power source 30 are applied to each of the dynode plates $\mathbf{32}_i$. The MDD 100 has an input end 41 for receiving ions or electrons and an output end 42 from which electrons exit the MDD 100. The input end 41 is sometimes referred to herein as the top 41 of the stack 36 of dynode plates 32 of the MDD 100 and the output end 42 is sometimes referred to herein as the bottom 42 of the stack 36 of dynode plates 32 of the MDD 100.

The number n of dynode plates 32 in the stack 36 ranges from greater than one plate to approximately thirty plates. Preferably, the number n of plates 32 in the stack 36 ranges from between ten and twenty plates. The exact number n for a given MDD 100 is primarily determined by the desired gain of the overall MDD 100 relative to the gain of a single dynode plate $\mathbf{32}_i$ within the stack 36. The gain of a single dynode plate $\mathbf{32}_i$ is defined as the number of secondary electrons 16 produced by the impact of a single ion 12 or electron on the plate $\mathbf{32}_i$. The gain of a dynode plate $\mathbf{32}_i$ is a function of the bias voltage and the electron emissivity characteristics of the dynode plate $\mathbf{32}_i$. One skilled in the art given knowledge of the plate material characteristics, the bias voltage level and the desired overall MDD 100 gain can readily determine a suitable number n for a given design of an MDD 100.

The dynode plates 32 are fabricated from thin, flat sheets of either a conductive material or from a non-conductive material coated with a conductive film. The thickness of the sheets can range from between about 0.003 inches to about 0.015 inches. Thinner sheets are preferred over thicker ones. Preferably, the plate thickness should be sufficient for a given application and material choice to maintain a relatively flat shape to insure consistent planar spaces between the sheets. Preferably, the thickness of the sheets ranges from approximately 0.005 inches to 0.008 inches.

The conductive material used to fabricate the flat sheets of the dynode plates 32 is preferably a metal, such as but not limited to, tantalum, molybdenum, aluminum, nickel, cupronickel or stainless steel. In the preferred embodiment, the dynode plates 32 are fabricated from stainless steel. Other metals may also be used. One skilled in the art could readily identify suitable materials and all such materials are within the scope of this invention.

As mentioned above, the dynode plates 32 are spaced apart from one another in the stack 36. The spacing between dynode plates 32 in the stack 36 can range from between 0.001 inch and 0.20 inch. Preferably, the spacing can range from between 0.005 inch and 0.020 inch. Spacing is achieved and maintained using electrically insulating spacers. The spacers are preferably located around the periphery of the dynode plates 32. The spacers are typically constructed from materials such as ceramic or a vacuum compatible plastic. Preferably, the electrical insulators that separate the dynode plates 32 are ceramic. Ceramic, in particular alumina, is known by those skilled in the art as a good electrical insulator that is chemically inert and compatible with a high vacuum environment. Other similar insulating materials may be used. One skilled in the art could readily identify suitable materials and all such materials are within the scope of this invention.

One surface of the dynode plates 32 may be coated with a material to enhance the yield of secondary electrons. Generally, the coating is applied to a top surface 37 of each dynode plate $\mathbf{32}_i$. The "top" surface 37 is defined as the surface of the dynode plate $\mathbf{32}_i$ in the stack 36 closest to or facing the input end or top 41 of the MDD 100. The coating is preferably an air-stable material with a high secondary electron yield. Materials known to function well as a coating in this application include, but are not limited to, Au, Pt, $MgF_2$, $SnO_2$, $SiO_2$, and $Al_2O_3$. One skilled in the art could readily identify a variety of other suitable coating materials and all of such materials are within the scope of this invention.

The coating is normally applied to the top surface 37 of the dynode plate $\mathbf{32}_i$ using any one of several conventional coating methods including, but not limited to, sputtering and evaporative deposition. Sputtering is the preferred method because it can accommodate a wide variety of coating materials and the coating produced thereby can be precisely controlled in terms of thickness and uniformity.

Each of the dynode plates $\mathbf{32}_i$ has a plurality of apertures 34 formed therein to allow secondary electrons 16 to pass through the thickness of the dynode plate $\mathbf{32}_i$ to an adjacent dynode plate $\mathbf{32}_i$. The aperture pattern of the dynode plate $\mathbf{32}_i$ and the number of apertures 34 in the plurality of apertures 34 is relatively arbitrary except that the ratio of aperture 34 area to the active area should be large. A maximum ratio is defined by the mechanical strength of the inter-aperture region 35 of the dynode plates 32. The function of the apertures 34 is to allow secondary electrons 16 produced by the impact of an ion or electron on a dynode plate $\mathbf{32}_i$ to cascade down through the stack 36 toward the output or bottom end 42 of the MDD 100. Therefore, a large ratio of aperture space to inter-aperture region 35 space improves the flow of secondary electrons through the MDD 100.

The active area of the dynode plate $\mathbf{32}_i$ surface is that portion of the dynode surface 37 the experiences either ion or electron impacts and subsequently produces secondary electron emissions. While impact events that produce secondary electron emissions may occur anywhere on the top surface 37 of the dynode plates 32, generally, the most productive portions of the dynode surface 37 in terms of probability of impact and secondary electron emission during operation of the MDD 100 are confined to those portions of the dynode plates $\mathbf{32}_2$ through $\mathbf{32}_n$ that overlap the apertures 34 in the respective overlying plates $\mathbf{32}_1$ through $\mathbf{32}_{n-1}$. The overlapping portions of the dynode plates 32, called the "active areas" 35*a*, are illustrated in FIG. 3 between dashed lines. Only one of the active areas 35*a* on one of the dynode plates $\mathbf{32}_i$ is so delineated in FIG. 3 for simplicity.

Figure 7:
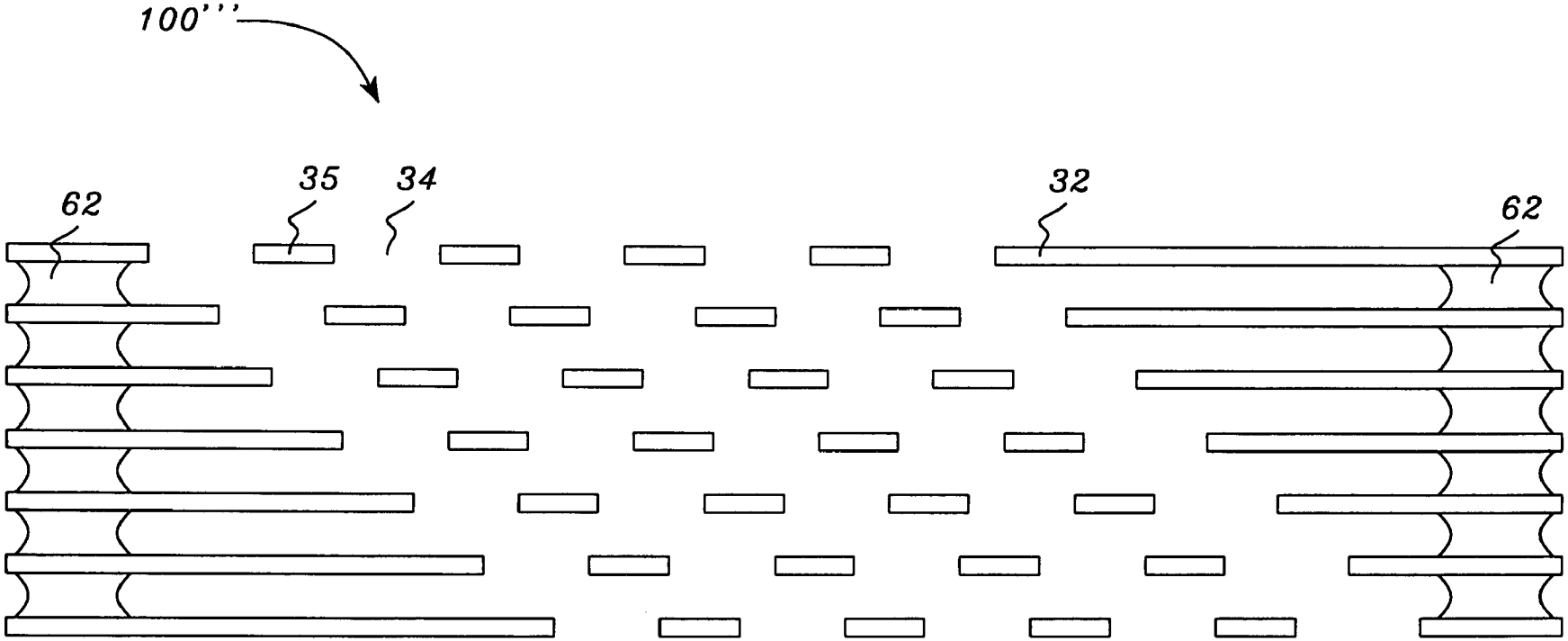
FIG. 7 illustrates a multi dynode device wherein the bias network is integrated onto the plates of the multi dynode device.

According to the invention, the aperture pattern of a given dynode plate $\mathbf{32}_i$ within the stack 36 is offset with respect to other dynode plates 32 immediately above and below it in the stack 36. This offset in the aperture pattern produces the overlap of the aperture 34 by non-aperture regions in adjacent dynode plates 32. The aperture pattern can be offset by either offset-stacking essentially identical dynode plates 32 or by constructing unique dynode plates 32 that each has a different, offset aperture pattern fabricated therein. The term "offset-stacking" as used herein means that each plate is placed on the stack 36 with a mechanical offset or mechanical bias relative to the dynode plates 32 immediately above and below it as illustrated in FIGS. 3 and 4. The term "fabricated offset aperture pattern" as used herein means that the aperture pattern formed on a given dynode plate $\mathbf{32}_i$ is offset or located differently with respect to the aperture pattern on what will be adjacent dynode plates 32 once the stack 36 is assembled as illustrated in FIG. 7. Additionally, for a fabricated offset pattern, the offset can be produced by using apertures of differing sizes instead of or in addition to apertures of differing locations in adjacent dynode plates 32.

The mechanical bias or offset combined with the number n of dynode plates 32 and the aperture pattern are determined such that all ions entering the input end 41 of the MDD 100 will encounter at least one dynode plate $\mathbf{32}_i$. Put another way, the mechanical bias of the apertures 34 in the stacked dynode plates 32 provides an angled array of holes through the MDD 100. The analyte ions or electrons that enter the MDP 100, and the secondary electrons 16 that are generated proceed through the MDD 100 with a "drift angle" associated with the mechanical bias of the apertures 34. The mechanical bias coupled with the plurality of apertures 34 in the stacked dynode plates 32 provide a plurality of collinear channels that, with appropriate electrical bias, facilitate electron multiplication between the input and the output of the MDD 100.

As noted above, the apertures 34 in adjacent plates 32 are offset from each other, such that the active area 35*a* of each plate $\mathbf{32}_i$ overlaps the apertures 34 in an adjacent plate. Preferably, the active area 35*a* of each plate $\mathbf{32}_i$ overlaps from about one half to about two thirds of the opening in each aperture 34 of adjacent plates 32. The use of an overlap of one half to two-thirds advantageously reduces the occurrence of ion feedback while minimizing differential gain. Moreover, if the dynode plates are assumed to be located in the x-y plane of a 3-dimensional Cartesian coordinate system with the z-axis aligned with the nominal direction of ion flow, the offset can be in either the x-direction, the y-direction or both the x-direction and the y-direction.

The apertures 34 of the dynode plates 32 can be formed in the conductive sheets by any one of a number of techniques well known in the art. Preferably the apertures 34 are formed by chemically etching the thin sheets. When chemical etching is used, the aperture pattern is defined using conventional precision etching methods that are well known in the art.

The stack 36 of dynode plates 32 may be assembled by alternately placing a dynode plate $\mathbf{32}_i$ and an insulating spacer onto an assembly frame. The assembly frame provides alignment pins that hold the plates 32 in a precise orientation with respect to one another. Offset stacking can be achieved by utilizing mechanically biased, inclined or slanted alignment pins. Alignment pins without a slant or mechanical bias are normally used to assemble plates 32 having offset aperture patterns. In the preferred embodiment, the stack 36 is assembled by offset stacking identical dynode plates 32 using inclined alignment pins.

Once the stack 36 is assembled, it can be held together using an external clamping frame or by spot-welding or gluing the dynode plates 32 together. Other techniques for securing the dynode plates 32 together in the stacked configuration should be readily apparent to one skilled in the art and are within the scope of this invention. Spot-welding is the preferred technique for securing the stack 36.

The MDD 100 stack 36 may be fabricated by other methods than those described above. Precision fabrication can be performed using any one of a variety of techniques including electroforming and three-dimensional etching. Additionally, the stack 36 and/or the individual dynode plates 32 used to make the stack 36 can be fabricated from a resistive or semiconductor material such as silicon carbide or doped silicon using conventional semiconductor fabrication techniques.

As described hereinabove, a bias voltage individually biases the dynode plates 32 of the MDD 100. The magnitude of the bias voltage applied to the dynode plate $\mathbf{32}_1$ closest to the top 41 of the MDD 100 is greater than the magnitude of the bias voltage applied to the dynode plate $\mathbf{32}_n$ closest to the bottom 42 of the MDD 100. Preferably the magnitude of the bias voltage of a given dynode plate $\mathbf{32}_i$ within the stack 36 is less than the magnitude of the bias voltage of the dynode plate $\mathbf{32}_i$ immediately above it and greater than the magnitude of the dynode plate immediately below it. The bias voltages are negative relative to ground potential. The magnitude and polarity of the bias voltages creates an electric field gradient that preferentially accelerates secondary electrons toward the bottom 42 of the MDD 100.

The bias voltages are supplied by a power source 30, typically a negative voltage supply 31, in conjunction with a bias network 38. In the preferred embodiment illustrated in FIG. 3, the bias network 38 comprises a capacitively loaded resistive voltage divider having an output corresponding to each of the dynode plates $\mathbf{32}_i$ in the MDD 100. The capacitively loaded resistive voltage divider is a voltage divider with a capacitor 39 placed in parallel with each resistor 40 of the voltage divider. Outputs of the capacitively loaded resistive voltage divider are electrically connected to each dynode plate $\mathbf{32}_i$. The capacitors 39 provide high peak current values preventing or at least reducing the onset of saturation that may occur without the capacitors 39. Preferably, the power source 30 produces an output voltage of approximately 1000 V. Typically the bias network 38 is designed to produce voltages at its outputs that linearly decrease with each successive output. Although a resistive voltage divider is preferred, one skilled in the art would readily recognize other ways of producing the desired bias voltages on the dynode plates 32 of the MDD 100, all of which are within the scope of the present invention.

In the preferred embodiment, the capacitively loaded resistive voltage divider of the bias network 38 is realized as a series of thick film resistors printed on an alumina ceramic substrate with either printed thick film capacitors or discrete chip capacitors electrically connected to the thick film resistors. However, the capacitively loaded resistive voltage divider may be fabricated using several other methods that are well known to one skilled in the art, including, but not limited to, using discrete resistors and discrete capacitors, all of which would work equally well in this application and are within the scope of the invention.

Figure 5:
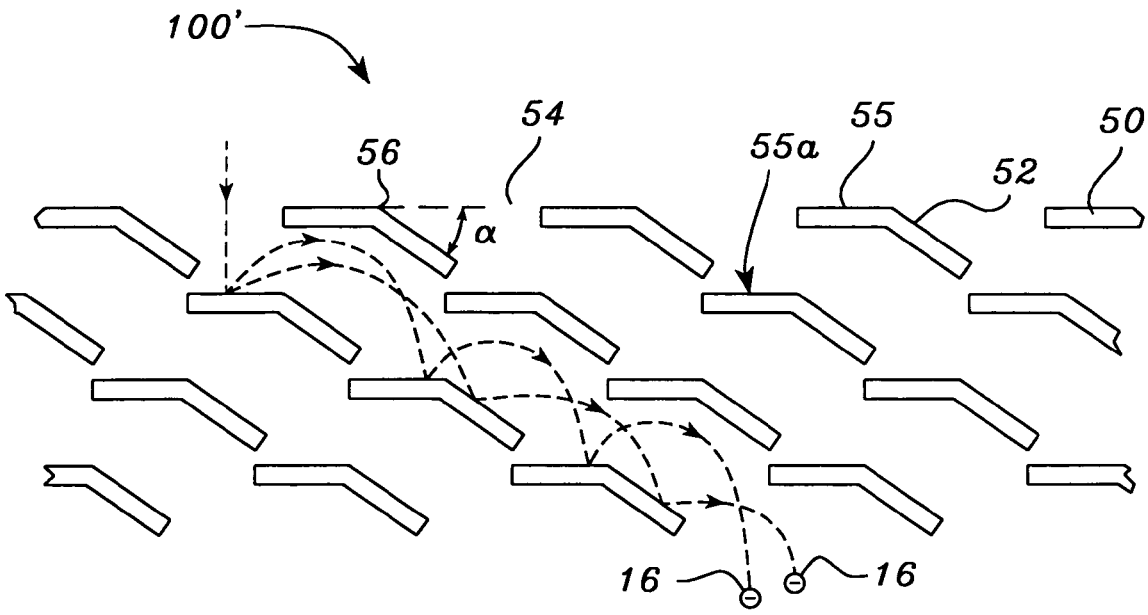
FIG. 5 illustrates an alternate embodiment of the multi dynode device of the present invention in which a portion of the active area of each dynode plate is inclined.

In another embodiment of the MDD 100' of the present invention illustrated in FIG. 5, the dynode plates 50 are formed such that a portion of the dynode plates 50 adjacent to the apertures 54 has an inclined dynode surface 52. The inclined dynode surface 52 begins at a bend-point 56. The bend-point 56 can be located in either the un-shadowed or the shadowed portion of the inter-aperture region 55. The dynode plates 50 are stacked together in this embodiment such that the inclined surfaces 52 on each plate $\mathbf{50}_i$ are aligned with the inclined surfaces 52 on adjacent plates 50. The inclined dynode surfaces 52 facilitate the acceleration of the secondary electrons in the direction of the output end 42 of the MDD 100'. Therefore, the inclined dynode surfaces 52 are preferably part of the active area 55*a*. The dynode surfaces 52 in this embodiment of the MDD 100' are generally wider than that of the MDD 100 embodiment illustrated in FIG. 3 and have an inclination angle $\alpha$ that ranges from approximately one degree to approximately thirty degrees. However, inclination angles $\alpha$ greater than about thirty degrees are still within the scope of the invention.

Figure 6:
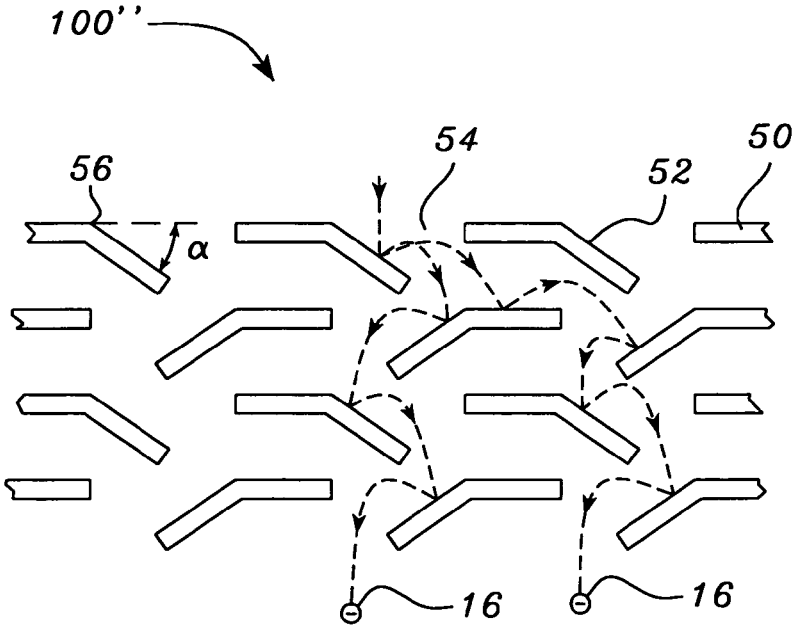
FIG. 6 illustrates an alternate embodiment of the present invention in which a portion of the active area of each dynode plate is inclined and reversed on alternate layers.

In yet another embodiment illustrated in FIG. 6, the dynode plates 50 of the MDD 100" comprise inclined dynode surfaces 52, wherein the plates 50 are alternately positioned in the stack with their inclined surfaces 52 oriented in opposite directions (i.e., left and right).

In yet still another embodiment of the MDD 100''' of the present invention, the bias network is integrated with the dynode plates 32. This embodiment is illustrated in FIG. 7, wherein the resistors 62 of the bias network are located between the dynode plates 32 and provide electrical contact between the plates 32. In this embodiment of the MDD 100''', the resistors 62 provide the necessary spacing between dynode plates 32 such that the insulating spacers between dynode plates 32 may be eliminated. The resistors 62 can be integrated onto the dynode plates 32 as thick film or thin film resistors 62, for example, printed or deposited directly onto the plate surface. The resistors 62 can be located either at discrete points on the periphery of the dynode plates 32 or provided in the form of an annular ring around the periphery of the dynode plates 32. In the preferred embodiment of the MDD 100'", the thick film resistors 62 function both as spacers as well as bias resistors 62. The thick film material is printed on each dynode plate $32_i$ and fired and then stacked together with appropriate electrical connection. Preferably, the resistors 62 are printed onto the individual dynode plates $32_i$ and then the dynode plates 32 are stacked and fired together to sinter the thick film resistors 62 between the plates 32 according to well known thick film and cofired ceramic circuit fabrication techniques. This approach has the added advantage that the fired thick film resistors 62 not only serve as spacers but also function to hold the stack together obviating the need for clamps or other mechanisms. Capacitors making up the capacitive loading portion of the bias network can also be fabricated directly on the dynode plates 32 using thick film and co-fired ceramic circuit fabrication techniques.

Figure 8:
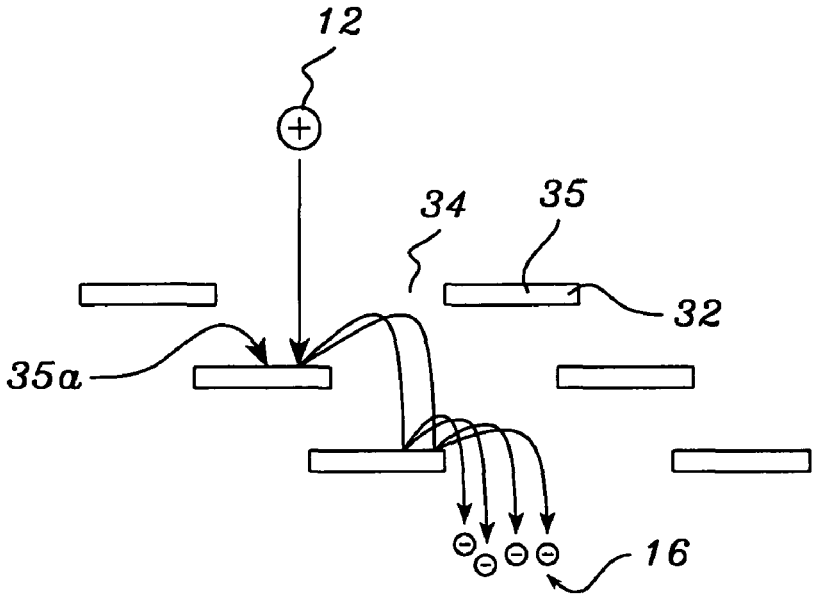
FIG. 8 illustrates the electron multiplication of the multi dynode device of the present invention.

The interception of an analyte ion 12 and the resulting amplification action by a portion of the MDD 100 of the present invention is illustrated in FIG. 8. An analogous amplification occurs when an electron is intercepted instead of an ion 12. Hereinafter, ion 12 and electron are referred to interchangeably unless otherwise noted. As illustrated, an ion 12 entering the input end 41 of the MDD 100, 100', 100", 100'" (hereinafter "MDD" for simplicity) eventually encounters and impacts one of the n dynode plates 32, 50 (hereinafter "32" for simplicity). Upon impact with the dynode plate 32, typically on the dynode active region 35*a*, 55*a* (hereinafter "35*a*" for simplicity), secondary electrons 16 are generated. For simplicity, only two secondary electrons 16 are illustrated being produced by each impact in FIG. 8. The actual number of secondary electrons 16 produced by each impact event is a function of the dynode plate 32 material, the properties of any coating on the dynode plate 32, the bias voltage applied to the dynode plate 32 and the energy of the incident ion or electron as is well known in the art.

The trajectory of the secondary electrons 16 produced thereby is affected by the electric field surrounding the dynode plates 32 that is produced by the applied bias voltages. The trajectories of the ion and of secondary electrons produced are depicted as curving lines in FIG. 8. The electric field preferentially accelerates the secondary electrons 16 toward the output end of the MDD. If these secondary electrons 16 encounter and impact with another dynode plate 32, in turn, they will produce additional secondary electrons 16. The electric field accelerates these additional secondary electrons 16 toward the output end 42 of the MDD as well. Therefore, the secondary electrons 16 cascade from one dynode plate 32 to another adjacent dynode plate 32 in the stack 36 through the plurality of apertures 34 until they exit the MDD. The gain of the MDD, as noted above, is the number of secondary electrons 16 that exit the MDD for each ion 12 that enters.

The nominal trajectories of secondary electrons 16 are also illustrated in FIGS. 5 and 6. The nominal trajectories are illustrated as curved dashed lines. For simplicity, only the trajectories of two secondary electrons 16 resulting from a single impact are illustrated. It is understood that many secondary electrons 16 may be produced from every ion/electron impact with each of the dynode plates 32 of the MDD.

The MDD of the present invention has the operational advantage of presenting a planar surface perpendicular to the drift direction of the ions or electrons entering the input end 41 of MDD. Thus, the MDD maximizes the detection sensitivity since ions or electrons associated with a given temporal event impact the MDD input 41 nearly simultaneously. In addition, the relatively thin overall structure of the MDD coupled with its planar structure is effective in minimizing the path differences associated with amplification, thereby preserving the temporal integrity of the input event. Advantageously, the MDD, comprising n independently biased dynode plates, greatly extends the onset of saturation resulting in a wide dynamic range unlike the case of the MCP 10 and other similar electron multipliers which do not have independent internal biasing. Therefore, the MDD of the present invention advantageously provides a high saturation level, a high sensitivity, and very low $\Delta t$ when compared with conventional electron multipliers.

Figure 9:
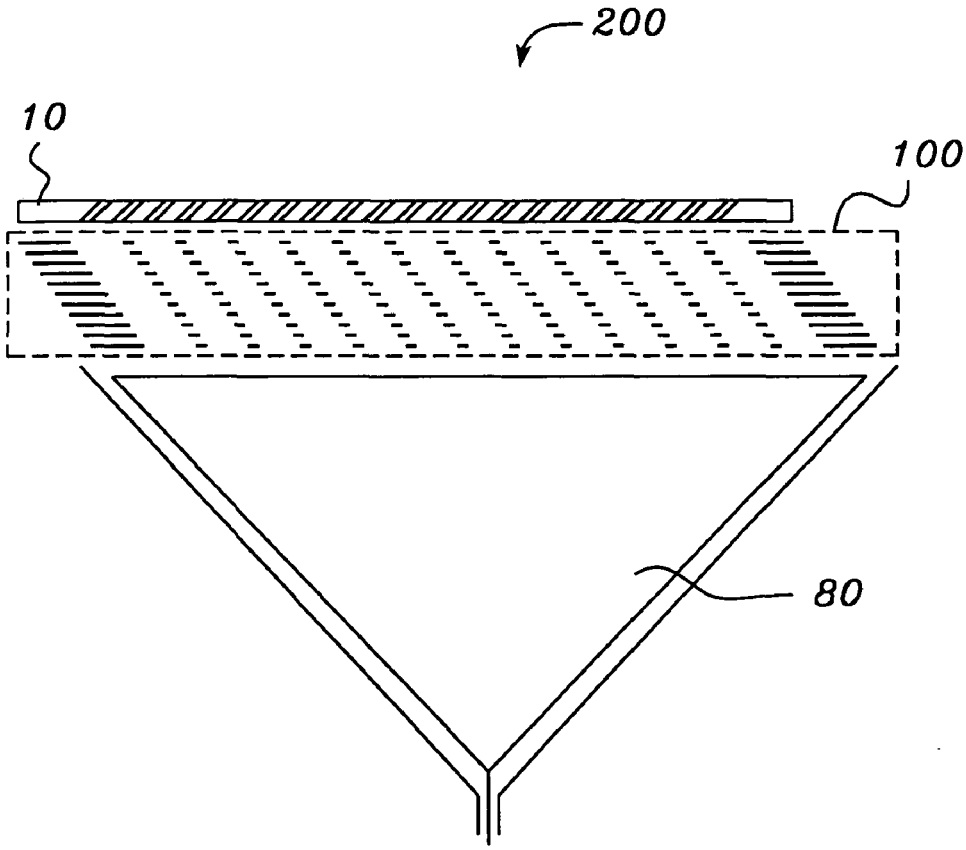
FIG. 9 illustrates a hybrid detector of the present invention.

In another aspect of the present invention, a hybrid detector 200 is provided. The hybrid detector 200 is illustrated in FIG. 9. The hybrid detector 200 comprises the MDD of the present invention interposed between a standard or conventional MCP 10 or similar electron multiplier and an anode 80. Preferably the anode 80 is an impedance matched conical anode.

The MCP 10 in the hybrid detector 200 of the present invention is operated under conditions that prevent or reduce the chances of the MCP 10 from going into "saturation" from a large input event. Typically this is accomplished by setting the magnitude of a voltage applied to the MCP 10 low enough such that the peak output current (i.e. effective production rate of secondary electrons 16) is still in a linear range for the largest expected peak input event. Thus, the MCP 10 advantageously provides a maximum gain and a minimum time-distortion output to the MDD in the detector 200 of the invention.

As described hereinabove, the MDD of the present invention provides a planar, flat, and compact structure like that of the input MCP 10, and thus, advantageously preserves the important temporal integrity of an input signal event. Moreover, the overall gain of the combination of the MCP 10 and MDD of the hybrid detector 200 of the present invention can be controlled by the distribution of the gain allotted to each of the MCP and the MDD.

Figure 10:
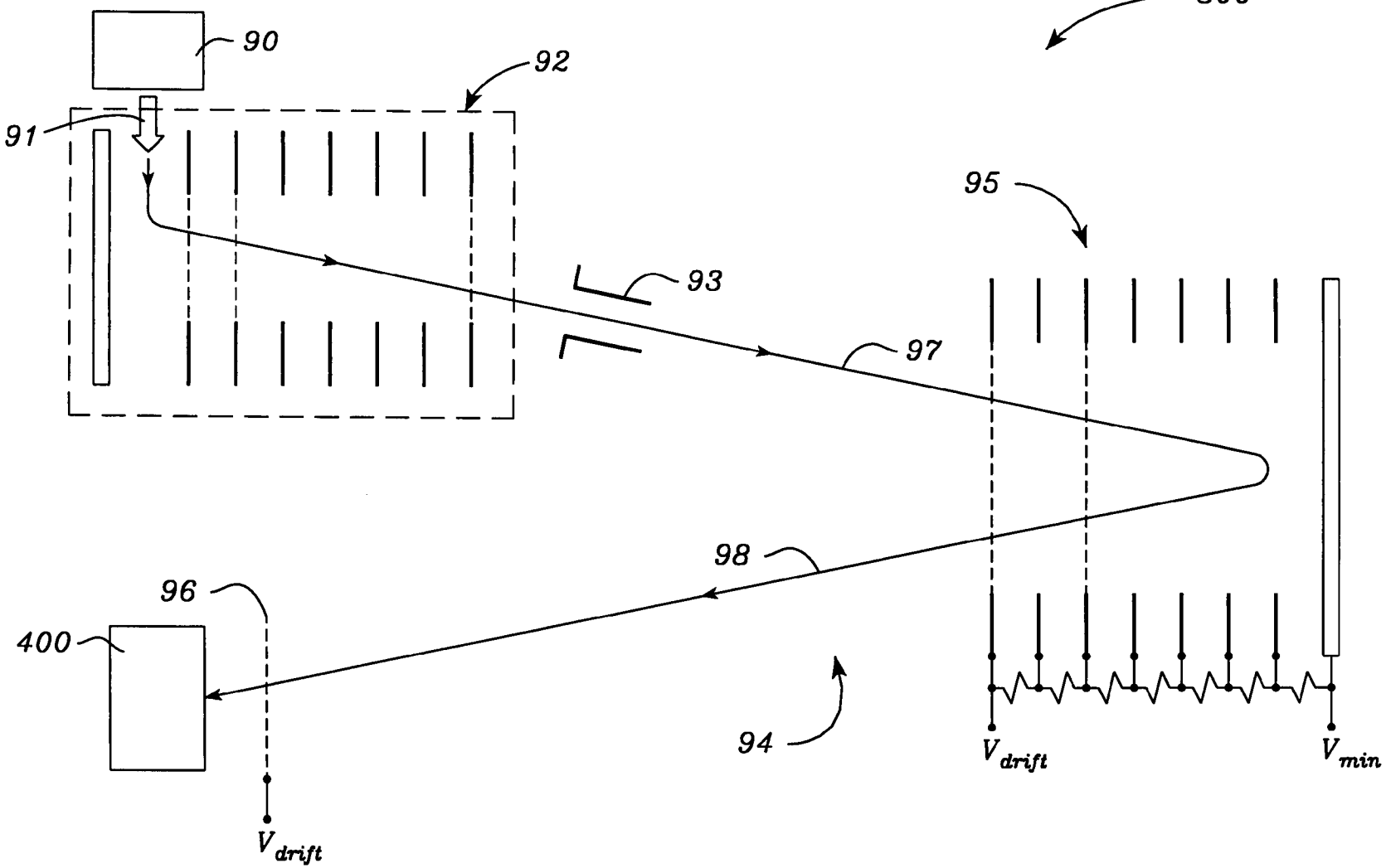
FIG. 10 illustrates a time-of-flight mass spectrometer incorporating the hybrid detector of the present invention.

In yet another aspect of the invention, a mass spectrometer 300 that incorporates the unique ion detection apparatus in accordance with the present invention is provided. FIG. 10 illustrates a time-of-flight mass spectrometer (TOFMS) 300 of the preferred embodiment comprising an ion detector 400 that comprises either the MDD or the hybrid detector 200 described hereinabove.

The TOFMS 300 further comprises an ion source 90, an ion accelerator 92, deflection plates 93, an ion drift region 94, a two-stage mirror 95, and a guard grid 96, which advantageously can be conventional components. The TOFMS 300 is housed in a vacuum chamber. The vacuum prevents interference from the motion of the ions resulting from the presence of an atmosphere.

The ion source 90 is positioned adjacent to the ion accelerator 92. Analyte ions 91 are accelerated into the drift region 94 by the ion accelerator 92. The analyte ions 91 leaving the accelerator 92 are grouped in bunches or packets separated in time. A pair of deflection plates 93 is placed in the drift region 94 to correct the ion trajectory and align the path 97 of the analyte ions with an aperture of the two-stage mirror 95. The drift region 94 is maintained at a potential of about $V_{drift}$ volts. The analyte ion packets 91 enter the two-stage electrostatic mirror 95. The mirror 95 equalizes the time-of-flight of the analyte ions 91 of the same mass with different initial coordinates and energies and increases the differential separation between analyte ions 91 having different masses. Reflected analyte ions packets pass back through the drift region 94, through the grid 96 to the ion detector 400 of the present invention along path 98 where the analyte ions 91 are detected as described above.

The present invention provides a mass spectrometer 300 that has high peak signal output currents and large dynamic range while preserving the time-dependent information of the input event and avoiding the generation of significant distortions or artifacts on the output signal. The ion detector 400 of the invention overcomes the above problems of the conventional hybrid detectors used in mass spectrometers by providing a unique EM portion that avoids the path-length differences and saturation.

Thus there has been described a new multi dynode device 100, 100', 100", 100'", a hybrid detector 200 using the MDD and a mass spectrometer 300 using either the MDD or hybrid detector 200 for mass spectrometry. It should be understood that the above-described embodiments are merely illustrative of the some of the many specific embodiments that represent the principles of the present invention. Clearly, those skilled in the art can readily devise numerous other arrangements without departing from the scope of the present invention.

What is claimed is:

1. A mass spectrometer comprising an ion source for providing analyte ions, a drift region, an ion accelerator for accelerating the analyte ions into the drift region, and an apparatus for electron multiplication and ion detection, the apparatus having an input end and an output end and comprising:

a multi dynode device comprising a plurality of dynode plates in a stacked relationship, each dynode plate of the plurality having a plurality of apertures, wherein the apertures of one dynode plate are offset from the apertures of adjacent dynode plates; and a power source connected to the multi dynode device.

2. The mass spectrometer of claim 1, wherein the apparatus further comprises a microchannel plate at the input end of the apparatus adjacent to the multi dynode device, and wherein the analyte ions enter the microchannel plate and produce electrons that enter the multi dynode device, and wherein the apertures in each dynode plate are offset such that the electrons impact one or more dynode plates to produce multiple secondary electrons with each impact.

3. The mass spectrometer of claim 1, wherein the mass spectrometer is a time-of-flight mass spectrometer.

* * * * *